US007474054B2

(12) United States Patent
Son et al.

(10) Patent No.: US 7,474,054 B2
(45) Date of Patent: Jan. 6, 2009

(54) PLASMA DISPLAY PANEL HAVING VARIABLE WIDTH DISCHARGE SPACES

(75) Inventors: Seung-hyun Son, Hwaseong-si (KR); Hidekazu Hatanaka, Seongnam-si (KR); Young-mo Kim, Suwon-si (KR); Sang-hun Jang, Yongin-si (KR); Ho-nyeon Lee, Seongnam-si (KR); Seong-eui Lee, Seongnam-si (KR); Xiaoqing Zeng, Suwon-si (KR); Gi-young Kim, Yongin-si (KR); Hyoung-bin Park, Seongnam-si (KR)

(73) Assignee: Samsung SDI Co., Ltd., Suwon (KR)

( * ) Notice: Subject to any disclaimer, the term of this patent is extended or adjusted under 35 U.S.C. 154(b) by 25 days.

(21) Appl. No.: 11/196,247

(22) Filed: Aug. 4, 2005

(65) Prior Publication Data

US 2006/0028139 A1 Feb. 9, 2006

(30) Foreign Application Priority Data

Aug. 5, 2004 (KR) ..... 10-2004-0061799

(51) Int. Cl.
*H01J 17/49* (2006.01)

(52) U.S. Cl. ..... 313/586; 313/587

(58) Field of Classification Search ..... None
See application file for complete search history.

(56) References Cited

U.S. PATENT DOCUMENTS 6,593,693 B1 * 7/2003 Takagi et al. ..... 313/586
2003/0151363 A1 * 8/2003 Lee et al. ..... 313/587
2004/0066354 A1 * 4/2004 Aoki et al. ..... 345/60
2004/0174120 A1 * 9/2004 Fujitani ..... 313/586
2004/0251831 A1 * 12/2004 Sung et al. ..... 313/582
2005/0225245 A1 * 10/2005 Seo et al. ..... 313/582

FOREIGN PATENT DOCUMENTS

| | | |
|---|---|---|
| CN | 1381862 | 11/2002 |
| CN | 1424739 | 6/2003 |
| EP | 1387386 A1 * | 2/2004 |
| JP | 2001-015038 | 1/2001 |
| JP | 2003-331740 | 11/2003 |

* cited by examiner

*Primary Examiner*—Toan Ton
*Assistant Examiner*—Britt Hanley
(74) *Attorney, Agent, or Firm*—H.C. Park & Associates, PLC

(57) ABSTRACT

A plasma display panel including a front substrate and a rear substrate separated by a predetermined distance, barrier ribs disposed between the front substrate and the rear substrate and partitioning a plurality of discharge spaces, a plurality of first sustain electrodes and second sustain electrodes disposed in parallel on an inner surface of the front substrate, and a plurality of first dielectric layers and second dielectric layers, covering the first sustain electrodes and the second sustain electrodes, respectively, parallel to the first and second sustain electrodes and separated from each other by predetermined narrow spaces and predetermined wide spaces.

4 Claims, 7 Drawing Sheets

PLASMA DISPLAY PANEL HAVING VARIABLE WIDTH DISCHARGE SPACES

CROSS REFERENCE TO RELATED APPLICATION

This application claims priority to and the benefit of Korean Patent Application No. 10-2004-0061799, filed on Aug. 5, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP that may have increased brightness and luminous efficiency at a low discharge voltage.

2. Discussion of the Background

Generally, PDPs, which form an image using gas discharge, have excellent display properties such as brightness and a large viewing angle. In PDPs, applying a discharge voltage to electrodes causes discharge to occur in a gas between the electrodes, thereby emitting ultraviolet rays that excite phosphors. The excited phosphors emit visible light as their energy level decreases.

FIG. 1 is a schematic perspective view showing a conventional reflection PDP, and FIG. 2 is a vertical cross-sectional view showing an internal structure of the PDP of FIG. 1. In FIG. 2, the rear substrate 20 is rotated by 90° to better show the conventional PDP's internal structure.

Referring to FIG. 1 and FIG. 2, the front substrate 10 and the rear substrate 20 face each other and are separated by a predetermined distance due to barrier ribs 24 formed therebetween. Thus, the front substrate 10, the rear substrate 20, and the barrier ribs 24 surround a discharge space 28.

A plurality of pairs of sustain electrodes 11*a* and 11*b* for surface discharge are disposed on an inner surface of the front substrate 10. The pairs of sustain electrodes 11*a* and 11*b* are usually formed of a transparent conductive material, such as indium tin oxide (ITO), so that they can transmit visible light. Narrow, metallic bus electrodes 12*a* and 12*b* may be disposed on the pairs of sustain electrodes 11*a* and 11*b* to enhance the sustain electrodes conductivity. The bus electrodes 12*a* and 12*b* may be formed of Ag, Al, or Cu, for example. A first dielectric layer 13 covers the pairs of sustain electrodes 11*a* and 11*b* and the bus electrodes 12*a* and 12*b*, and a protective layer 14 covers the first dielectric layer 13.

A plurality of address electrodes 21 are disposed on an inner surface of the rear substrate 20 in a direction perpendicular to the pairs of sustain electrodes 11*a* and 11*b*, and a second dielectric layer 23 covers the address electrodes. The barrier ribs 24, having a predetermined height, are disposed in parallel with, and separated from, each other on the second dielectric layer 23. A fluorescent layer 25 is disposed on sidewalls of the barrier ribs 24 and on the second dielectric layer 23.

Such a conventional PDP may have the following problems.

First, a large distance between sustain electrodes may increase gas discharge efficiency, but it may require a higher discharge voltage.

Second, a high partial pressure of discharge gas in a discharge space may increase gas discharge efficiency, but it may require a high discharge voltage.

Thus, there is a need for a PDP having increased brightness and luminous efficiency using a low discharge voltage.

SUMMARY OF THE INVENTION

The present invention provides a plasma display panel (PDP) having a portion of a discharge space in which a relatively stronger electric field can be generated, thus exhibiting increased brightness and luminous efficiency at a low discharge voltage.

Additional features of the invention will be set forth in the description which follows, and in part will be apparent from the description, or may be learned by practice of the invention.

The present invention discloses a PDP including a front substrate and a rear substrate with a gap therebetween, barrier ribs disposed in the gap and partitioning a plurality of discharge spaces, a first sustain electrode and a second sustain electrode disposed in parallel to each other and on an inner surface of the front substrate, and a first dielectric layer covering the first sustain electrode and a second dielectric layer covering the second sustain electrode. The first dielectric layer and the second dielectric layer are separated from each other by at least a first space and a second space, wherein the first space is narrower than the second space.

The present invention discloses a PDP including a front substrate and a rear substrate with a gap therebetween, barrier ribs disposed in the gap to partition a plurality of discharge spaces, a first sustain electrode and a second sustain electrode disposed in parallel on an inner surface of the front substrate, a first dielectric layer covering the first sustain electrode and the second sustain electrode, an address electrode disposed on an inner surface of the rear substrate and in a direction substantially perpendicular to the first sustain electrode and the second sustain electrode, a second dielectric layer covering the address electrode, and a third dielectric layer disposed on and parallel to the address electrode.

The present invention discloses a PDP including a front substrate and a rear substrate separated by a predetermined distance, barrier ribs disposed between the front substrate and the rear substrate such that a plurality of discharge spaces are formed, a plurality of first sustain electrodes and second sustain electrodes disposed substantially in parallel on an inner surface of the front substrate, a first dielectric layer in which the first sustain electrodes and the second sustain electrodes are embedded, a plurality of address electrodes disposed on an inner surface of the rear substrate and in a direction substantially perpendicular to the first sustain electrodes and the second sustain electrodes and substantially parallel to the barrier ribs. Portions of the address electrodes are disposed between the barrier ribs and the rear substrate. A second dielectric layer covers the address electrodes, and a fluorescent layer is disposed on sidewalls of the discharge spaces.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Hereinafter, a plasma display panel (PDP) according to embodiments of the present invention will be described in detail with reference to the attached drawings.

Figure 1:
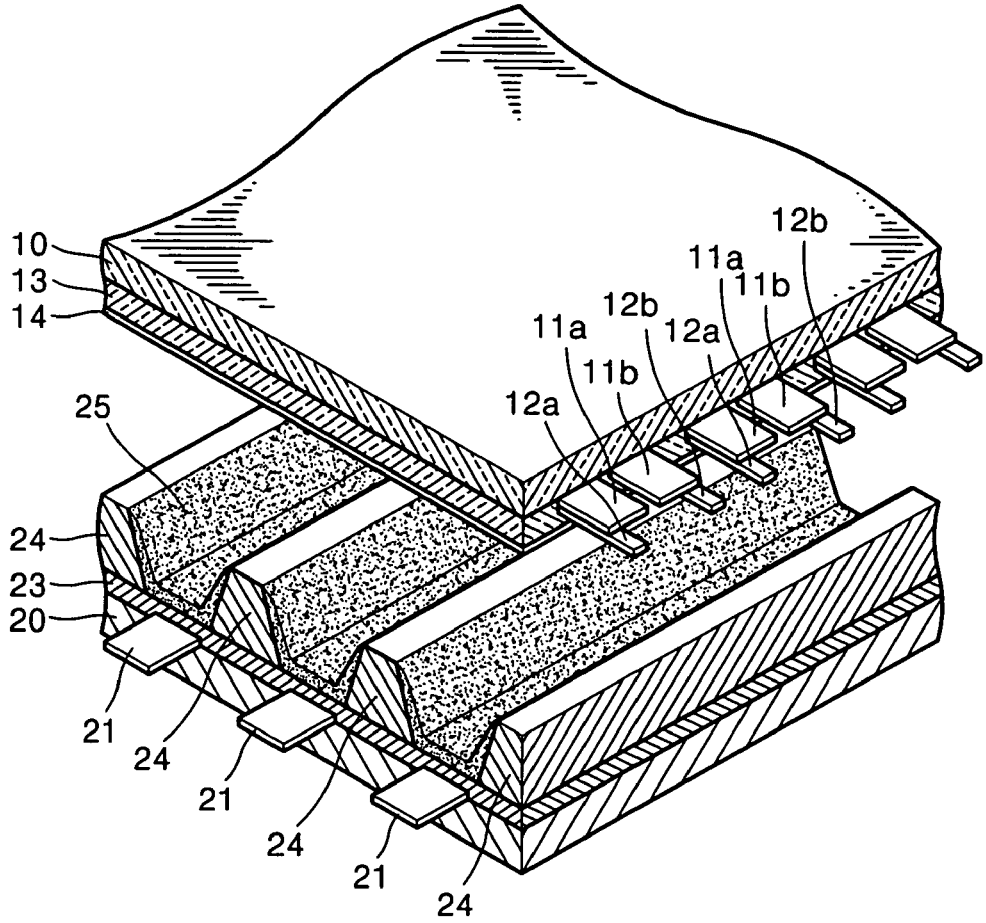
FIG. 1 (PRIOR ART)
FIG. 1 is a schematic perspective view showing a conventional reflection PDP.
Figure 2:
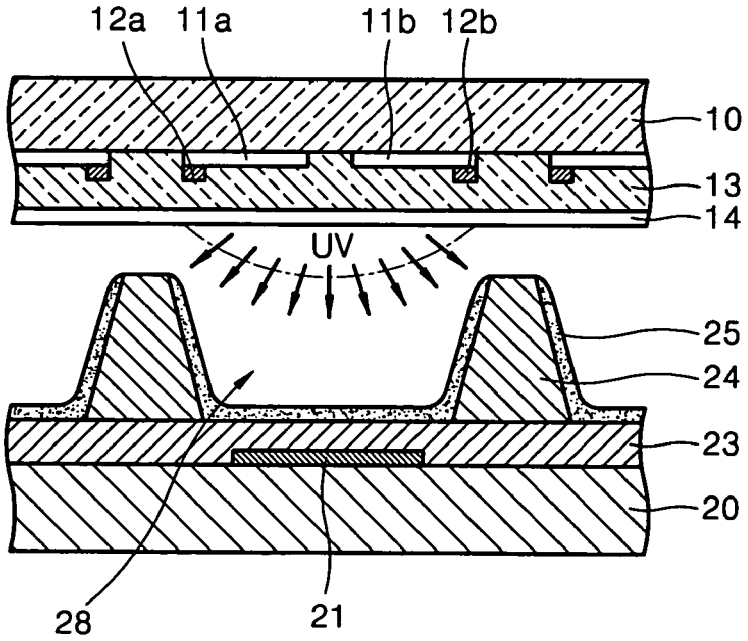
FIG. 2 (PRIOR ART)
FIG. 2 is a vertical cross-sectional view showing an internal structure of the PDP of FIG. 1.
Figure 3:
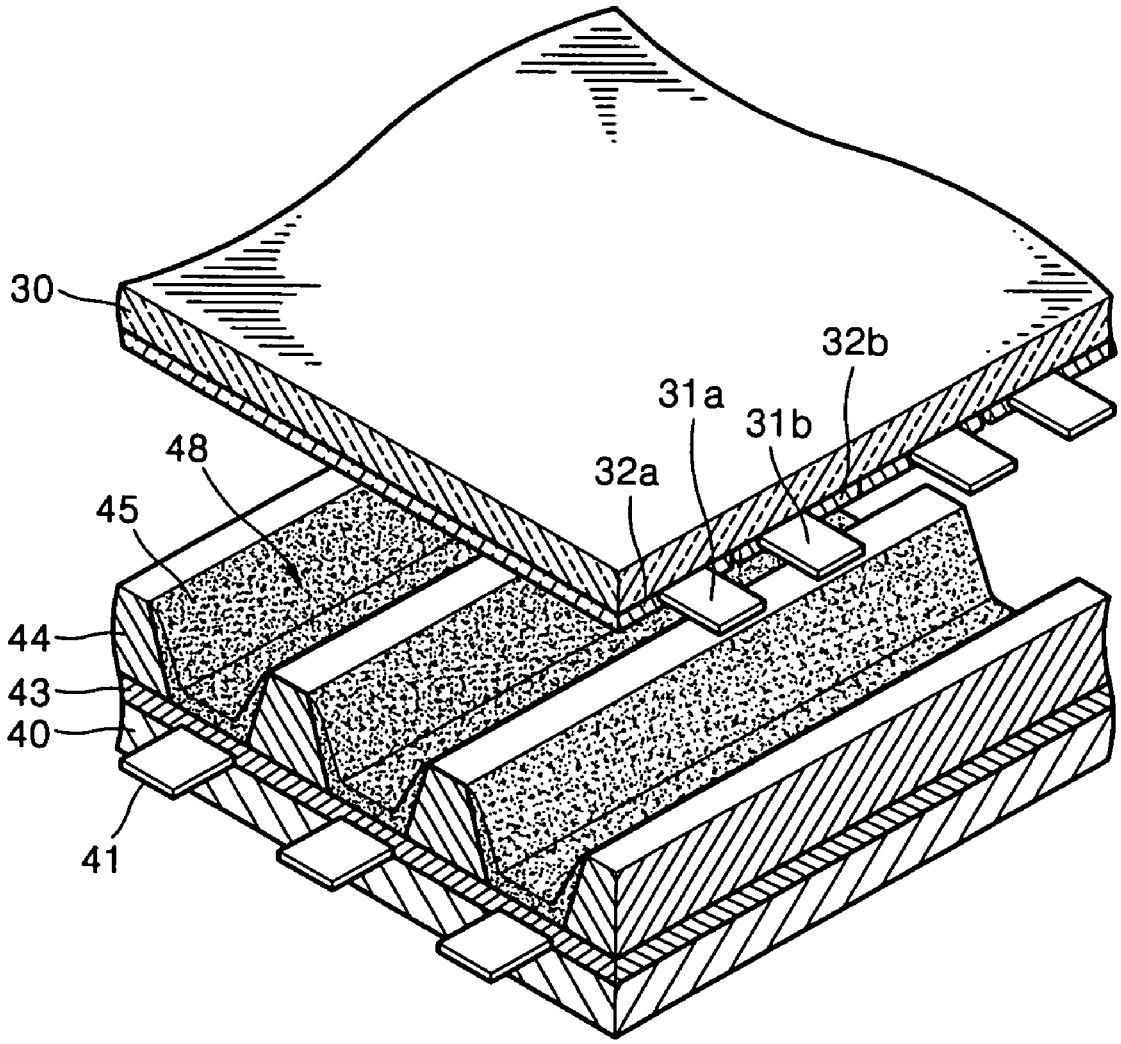
FIG. 3 is a schematic perspective view showing a reflection PDP according to an embodiment of the present invention.
Figure 4:
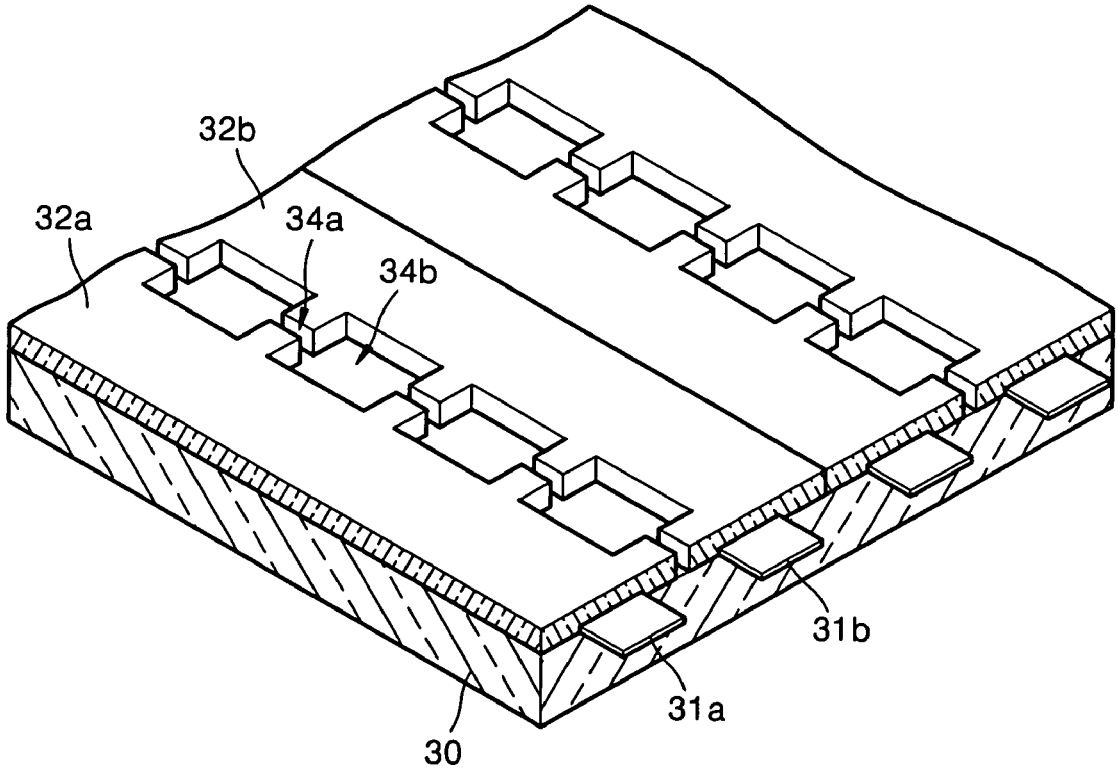
FIG. 4 is a perspective view of the bottom of a front substrate of the reflection PDP of FIG. 3 showing a shape of the space between dielectric layers.

FIG. 3 is a schematic perspective view showing a reflection PDP according to an embodiment of the present invention. FIG. 4 is a perspective view of the bottom of a front substrate of the PDP of FIG. 3 showing a shape of the space between dielectric layers.

Referring to FIG. 3 and FIG. 4, a front substrate 30 and a rear substrate 40 face 20 each other with a plurality of barrier ribs 44 disposed therebetween. Thus, the front substrate 30, the rear substrate 40, and the barrier ribs 44 surround a plurality of discharge spaces 48.

A plurality of pairs of first sustain electrodes and second sustain electrodes 31*a* and 31*b* may be disposed in parallel on an inner surface of the front substrate 30. The first and second sustain electrodes 31*a* and 31*b* are formed of a transparent conductive material, such as, for example, ITO, so that they can transmit visible light. A first dielectric layer and a second dielectric layer 32*a* and 32*b* cover the first sustain electrode 31*a* and the second sustain electrode 31*b*, respectively. The first and second dielectric layers 32*a* and 32*b* may have the same thickness. The first dielectric layer 32*a* may include $SiO_2$, $Al_2O_3$, $B_2O_3$, ZnO, and PbO. The second dielectric layer 32*b* may include $SiO_2$, $B_2O_3$, and PbO.

A plurality of address electrodes 41 may be disposed on an inner surface of the rear substrate 40 in a direction substantially perpendicular to the first and second sustain electrodes 31*a* and 31*b*, and a third dielectric layer 43 covers the address electrodes 41. The barrier ribs 44 have a predetermined height and may be disposed on the third dielectric layer 43 in parallel to, and in between, the address electrodes 41. The barrier ribs 44 may comprise $SiO_2/PbO/B_2O_3$, $SiO_2/PbO/B_2O_3/BaO$ or $SiO_2/Bi_2O_3/B_2O_3$. Additionally, $TiO_2$ and $Al_2O_3$ may also be included in the barrier ribs 44 as fillers. Fluorescent layers 45 may be disposed on sidewalls of the barrier ribs 44 and on the third dielectric layer 43.

The first and second dielectric layers 32*a* and 32*b* may be disposed substantially parallel to the first and second sustain electrodes 31*a* and 31*b*, and they may have predetermined narrow spaces 34*a* and predetermined wide spaces 34*b* therebetween. Thus, partially narrow discharge spaces may be formed between the first and second dielectric layers 32*a* and 32*b*.

The width of the space between the first and second dielectric layers 32*a* and 32*b* is inversely proportional to the intensity of an electric field generated between the first and second dielectric layers 32*a* and 32*b*. Thus, as the width of the space between the first and second dielectric layers 32*a* and 32*b* decreases, the intensity of the electric field increases. That is, a discharge may be easily started and maintained, even at a low discharge voltage, in the narrow spaces 34*a*.

Additionally, in the wide spaces 34*b*, a highly efficient gas discharge may be induced, and since an area where the dielectric layers 32*a* and 32*b* are not formed is broad, brightness and luminous efficiency may increase.

The narrow spaces 34*a* may be about 10 μm to 60 μm wide, and the wide spaces 34*b* may be about 70 μm to 600 μm wide.

The first and second dielectric layers 32*a* and 32*b* may be formed using, for example, a lithographic process, a sand blast process, or a screen printing process.

According to embodiments of the present invention, a discharge voltage may be decreased by controlling intervals between the first and second dielectric layers 32*a* and 32*b*. That is, by utilizing the structure having the narrow spaces 34*a* and the wide spaces 34*b*, a portion of a discharge space formed between the first and second dielectric layers 32*a* and 32*b* may have a relatively stronger electric field. Thus, a PDP having increased brightness and luminous efficiency at a low discharge voltage may be produced.

Figure 5:
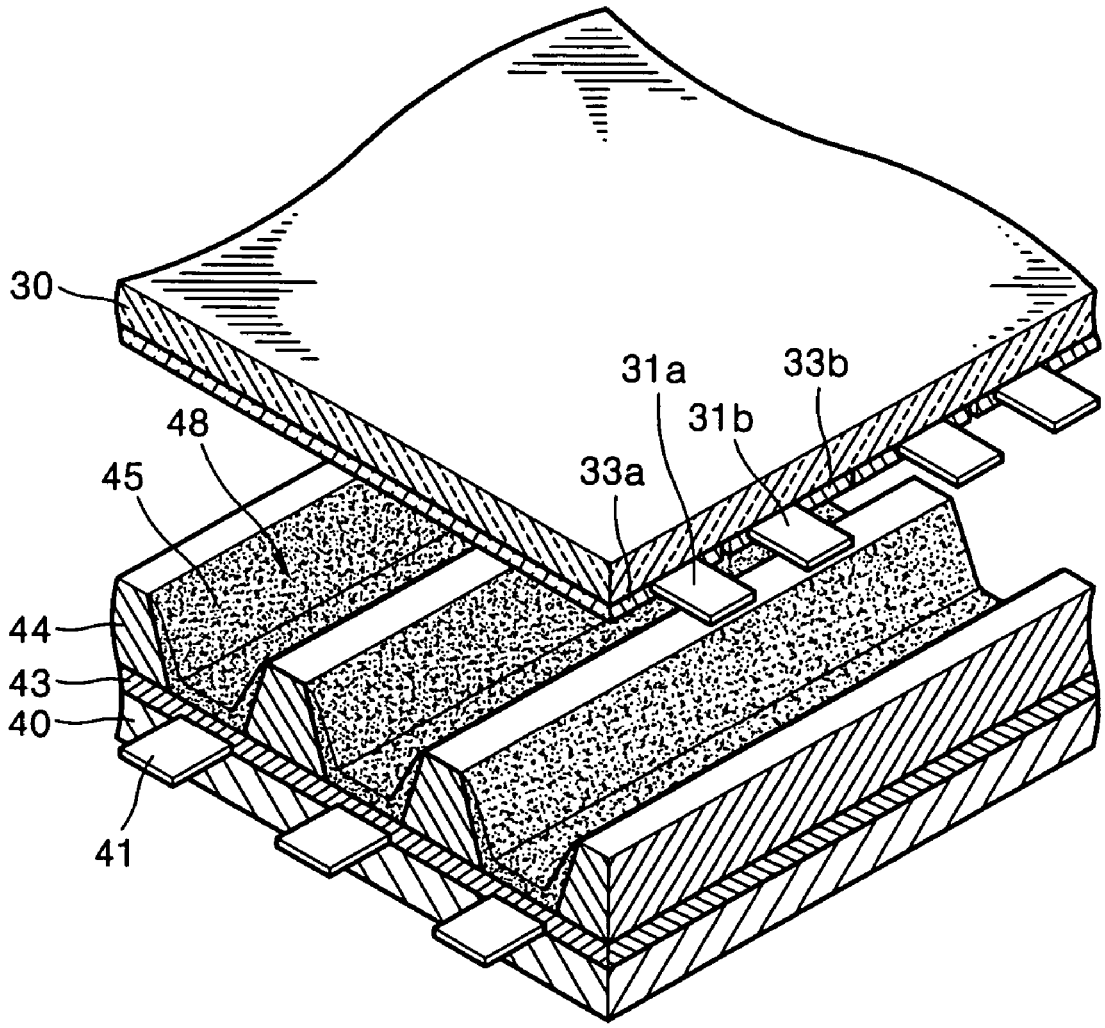
FIG. 5 is a schematic perspective view showing a reflection PDP according to another embodiment of the present invention.
Figure 6:
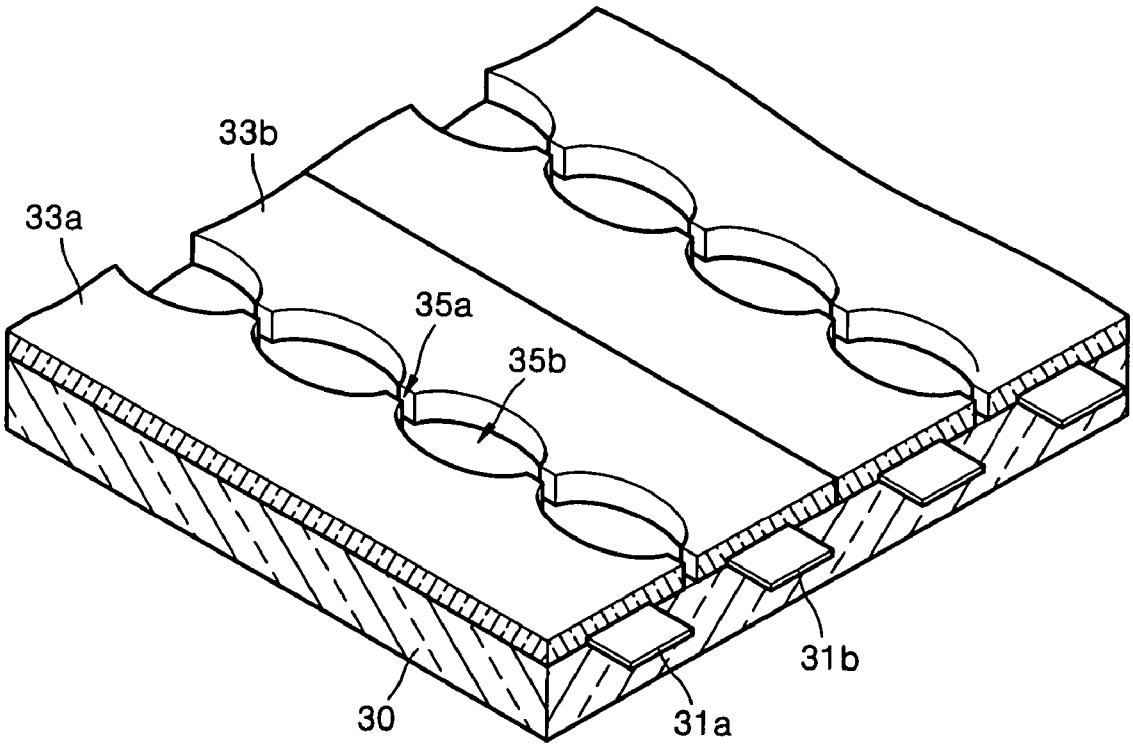
FIG. 6 is a perspective view of the bottom of a front substrate of the reflection PDP of FIG. 5 showing a shape of the space between dielectric layers.

FIG. 5 is a schematic perspective view showing a reflection PDP according to another embodiment of the present invention, and FIG. 6 is a perspective view of the bottom of a front substrate of the PDP of FIG. 5 showing a shape of space between dielectric layers. In the present embodiment, portions different from those in the previous embodiment illustrated in FIG. 3 and FIG. 4 will be explained. Like reference numerals in the drawings denote like elements.

Referring to FIG. 5 and FIG. 6, predetermined narrow spaces 35*a* and predetermined wide spaces 35*b* may be formed in the PDP according to the present embodiment so that the wide spaces 35*b* have an elliptic shape. Such a modification can be easily understood from the embodiment shown in FIG. 4. The narrow spaces 35*a* may be about 10 μm to 60 μm wide, and the wide spaces 35*b* may be, at their widest point, about 70 μm to 600 μm wide.

Similarly to the embodiment shown in FIG. 4, a relatively stronger electric field may be generated in the narrow spaces 35*a* between the first and second dielectric layers 33*a* and 33*b*, and thus, a PDP having increased brightness and luminous efficiency at a low discharge voltage may be produced. Although not shown in FIG. 3, FIG. 4, FIG. 5 or FIG. 6, a metallic bus electrode may be formed on each sustain electrode of the sustain electrode pairs 31*a* and 31*b*.

Figure 7:
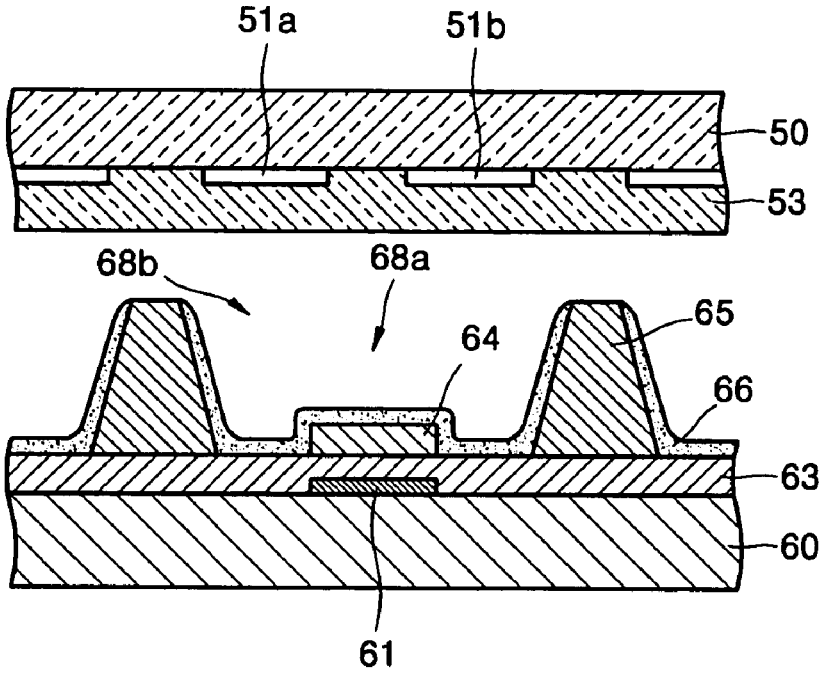
FIG. 7 is a vertical cross-sectional view showing an internal structure of a reflection PDP according to another embodiment of the present invention.

FIG. 7 is a vertical cross-sectional view showing an internal structure of a reflection PDP according to another embodiment of the present invention.

Referring to FIG. 7, a front substrate 50 and a rear substrate 60 face each other with a plurality of barrier ribs 65 therebetween. Thus, the front substrate 50, the rear substrate 60, and the barrier ribs 65 surround a plurality of discharge spaces. The rear substrate 60 is shown rotated by 90°.

A plurality of pairs of first sustain electrodes and second sustain electrodes 51*a* and 51*b* may be disposed in parallel on an inner surface of the front substrate 50. The first and second sustain electrodes 51*a* and 51*b* may be formed of a transparent conductive material, such as ITO, so that they can transmit visible light. A first dielectric layer 53 covers the first and second sustain electrodes 51*a* and 51*b*.

A plurality of address electrodes 61 may be disposed on an inner surface of the rear substrate 60 and in a direction substantially perpendicular to the first and second sustain electrodes 51*a* and 51*b*. A second dielectric layer 63 covers the address electrodes 61. A plurality of third dielectric layers 64 having predetermined widths may be disposed on, and parallel to, the address electrodes 61, thereby forming ridge portions on the address electrodes 61.

Figure 9:
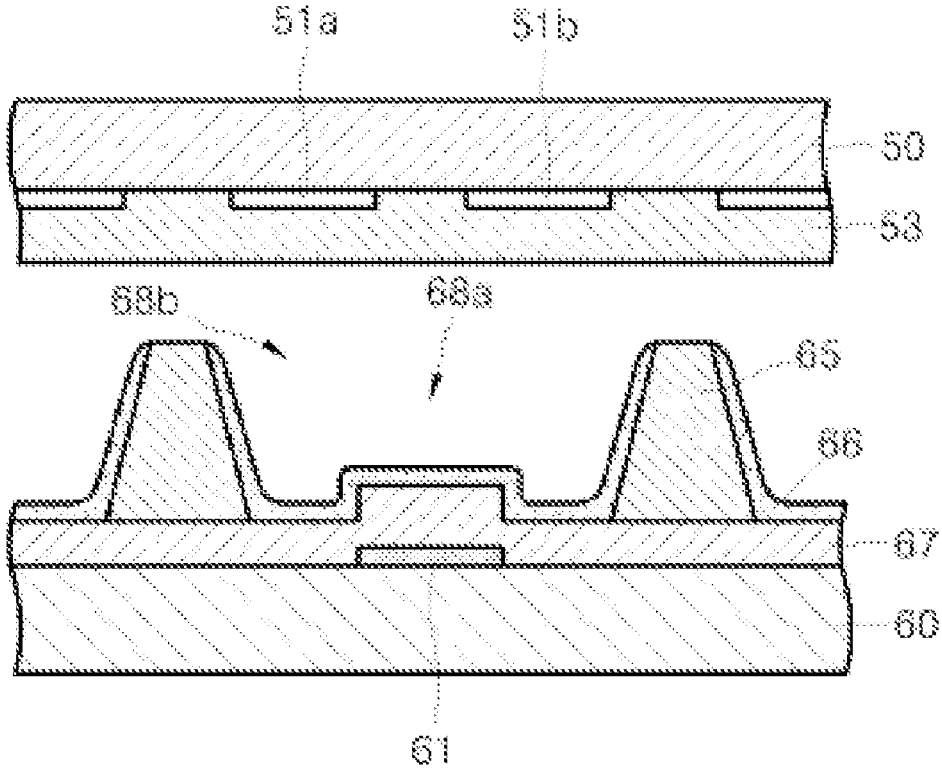
FIG. 9 is a vertical cross-sectional view showing an internal structure of a POP according to another exemplary embodiment of the present invention.

The barrier ribs 65 have a predetermined height and are disposed on the second dielectric layer 63 in parallel with, and in between, the address electrodes 61. Fluorescent layers 66 are disposed on sidewalls of the barrier ribs 65, on the second dielectric layer 63, and on the third dielectric layers 64. The second dielectric layer 63 and the third dielectric layers 64 may be formed as an integrated body 67 as shown in FIG. 9.

Forming the ridge portions using the third dielectric layers 64 forms narrow spaces 68*a* and wide spaces 68*b* between the second/third dielectric layers 63/64 and the first dielectric layer 53, in which a relatively stronger electric field is generated. That is, the narrow spaces 68*a* and the wide spaces 68*b* are formed in a discharge space. As with the embodiment shown in FIG. 4, a relatively stronger electric field may be generated in the narrow spaces 68*a*, and thus, a PDP having increased luminous efficiency at a low discharge voltage may be produced.

Address discharge may be easily started in the narrow spaces 68*a*, even at a low address voltage. High efficiency of gas discharge may be induced in the wide spaces 68*b*, and thus, luminous efficiency may increase.

The second dielectric layer 63 and the third dielectric layers 64 can be formed using, for example, a lithographic process, a sand blast process, or a screen printing process.

Figure 8:
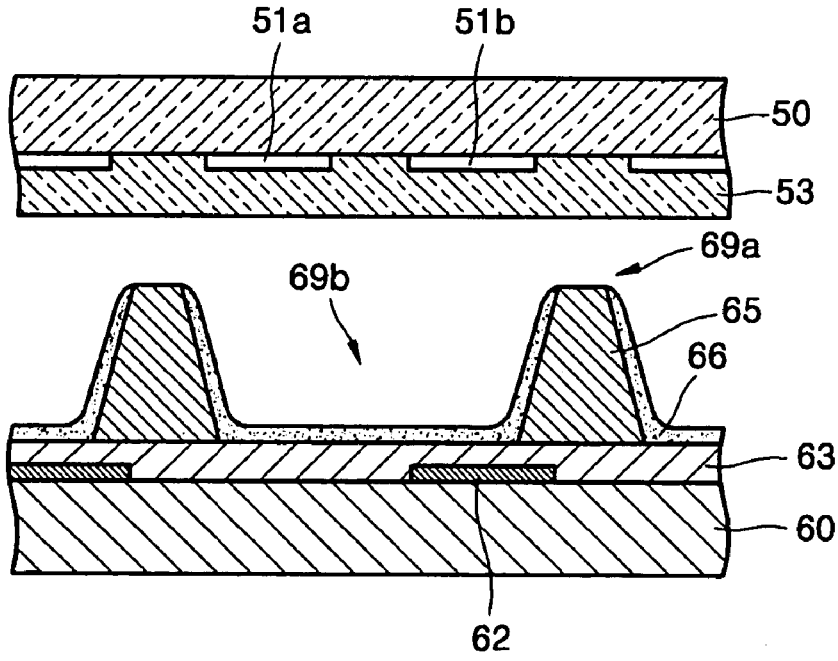
FIG. 8 is a vertical cross-sectional view showing an internal structure of a reflection PDP according to yet another embodiment of the present invention.

FIG. 8 is a vertical cross-sectional view showing an internal structure of a reflection PDP according to yet another embodiment of the present invention. In the present embodiment, portions different from those in the embodiment illustrated in FIG. 7 will be explained. Like reference numerals in the drawings denote like elements. The rear substrate 60 is shown rotated by 90°.

Referring to FIG. 8, a plurality of address electrodes 62 may be disposed on an inner surface of the rear substrate 60 and in a direction substantially perpendicular to the first and second sustain electrodes 51*a* and 51*b*, and a second dielectric layer 63 covers the address electrodes 62. A plurality of barrier ribs 65 having a predetermined height are disposed on the second dielectric layer 63 in parallel with, and separated from, each other by a predetermined distance. Fluorescent layers 66 are disposed on sidewalls of the barrier ribs 65 and on the second dielectric layer 63.

In the present embodiment, portions of the address electrodes 62 may be disposed between the barrier ribs 65 and the rear substrate 60. More specifically, about 10 μm or more of the address electrode 62 may be disposed under the barrier rib 65. In this way, a narrow discharge space 69*a* is formed between the second sustain electrodes 51*b*, covered by the first dielectric layer 53, and the barrier ribs 65, in which a relatively stronger electric field may be generated.

Thus, as described in the embodiment shown in FIG. 7, a PDP having increased luminous efficiency at a low discharge voltage may be produced. That is, an address discharge may be easily started even at a low address voltage in the narrow spaces 69*a* in which a relatively stronger electric field may be generated, and highly efficient gas discharge may be induced in the wide spaces 69*b*, thus increasing luminous efficiency. Although not shown in FIG. 7 or FIG. 8, a metallic bus electrode may be formed on each sustain electrode of the sustain electrode pairs.

The PDP according to embodiments of the present invention may have the following effects.

First, narrow spaces and wide spaces may be disposed between the first and second dielectric layers, thereby forming variable-width discharge spaces between the first and second dielectric layers to generate a relatively stronger electric field in the narrow spaces. Thus, the discharge voltage may decrease and brightness and luminous efficiency may increase.

Second, ridge portions comprised of dielectric layers may be formed on the address electrodes. Thus, variable-width discharge spaces may be formed between the address electrodes and the sustain electrodes to generate a relatively stronger electric field in the narrow spaces. Thus, the address voltage may decrease and luminous efficiency may increase.

Third, portions of the address electrodes may be disposed between the barrier ribs and the rear substrate. Thus, variable-width discharge spaces may be formed between the address electrodes and the sustain electrodes to generate a relatively stronger electric field in the narrow spaces. Thus, the address voltage may decrease and luminous efficiency may increase.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a front substrate and a rear substrate with a gap therebetween;

barrier ribs disposed in the gap to partition a plurality of discharge spaces;

a first sustain electrode and a second sustain electrode disposed in parallel on an inner surface of the front substrate;

a first dielectric layer covering the first sustain electrode and the second sustain electrode;

an address electrode disposed on an inner surface of the rear substrate and in a direction substantially perpendicular to the first sustain electrode and the second sustain electrode;

a second dielectric layer covering the address electrode; and a third dielectric layer disposed on and parallel to the address electrode, wherein a sum of a thickness of the second dielectric layer and a thickness of the third dielectric layer, both measured in a region corresponding to the address electrode, exceeds a thickness of the second dielectric layer measured in a region separated from the address electrode.

2. The PDP of claim 1, wherein the second dielectric layer and the third dielectric layer are formed as an integrated body.

3. The PDP of claim 1, wherein the third dielectric layer and the address electrode have the same width.

4. The PDP of claim 1, wherein the first sustain electrode and the second sustain electrode each comprise a metallic bus electrode coupled to a transparent electrode.

* * * * *